United States Patent [19]

Friedman

[11] 4,168,607

[45] Sep. 25, 1979

[54] POP-UP CASE AND RELATED DISPLAY CONTROLS IN AN ELECTRONIC WRISTWATCH

[75] Inventor: Howard M. Friedman, Middlebury, Conn.

[73] Assignee: Wells Benrus Corporation, Ridgefield, Conn.

[21] Appl. No.: 686,564

[22] Filed: May 14, 1976

[51] Int. Cl.[2] ..... G04B 19/24; G04B 19/30; G04B 37/14

[52] U.S. Cl. ..... 58/88 R; 58/4 A; 58/50 R; 58/58; 58/91

[58] Field of Search ..... 58/4 A, 23 R, 50 R, 58/53-55, 58, 88 R, 88 E, 89, 91, 88 WC

[56] References Cited

U.S. PATENT DOCUMENTS

| | | | |
|---|---|---|---|
| 1,804,048 | 5/1931 | Bosch | 58/88 E |
| 3,992,870 | 11/1976 | Dekel | 58/23 BA |
| 4,015,418 | 4/1977 | Rochat | 58/23 R |
| 4,019,037 | 4/1977 | Monna | 58/50 R |

FOREIGN PATENT DOCUMENTS

| | | | |
|---|---|---|---|
| 161610 | 5/1933 | Switzerland | 58/88 WC |

*Primary Examiner*—Edith S. Jackmon
*Attorney, Agent, or Firm*—H. Gordon Dyke

[57] ABSTRACT

The illustrated embodiment of my invention is a wrist watch having a watch case and a fixed seat outside of it. The watch case is movably mounted relative to the seat and is recessed within that seat. A spring normally holds the case in a rest position recessed within the seat. The case contains a quartz crystal, a circuit board, and an electro-optical data display at a window in the case. Manual actuation of a press-on member, specifically here a push button, against the resisting spring causes the case to move and thereby close a switch that causes the current time reading to appear on the display. Other displays occur successively if the case is soon enough manually moved part of the way back to its rest position and allowed to pop back up from there. When the case is left either up or down for more than a predetermined time for showing one kind of data the display circuit will automatically open and remain open until the case again moves up from a position sufficiently recessed to have opened the display circuit.

15 Claims, 14 Drawing Figures

FIG. 9
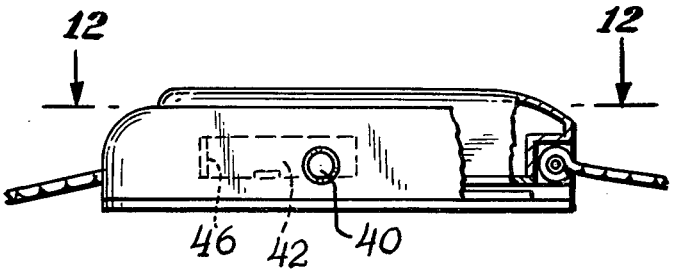
FIG. 10
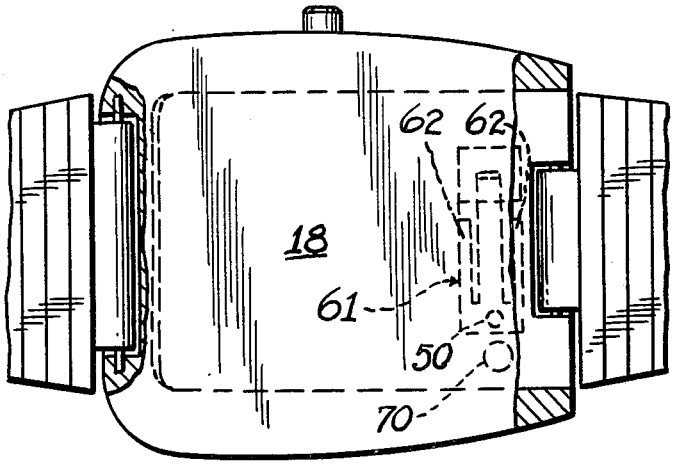
FIG. 11
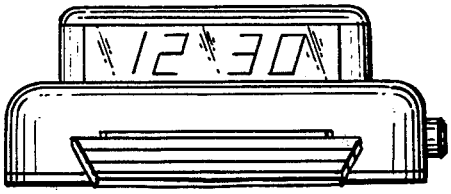
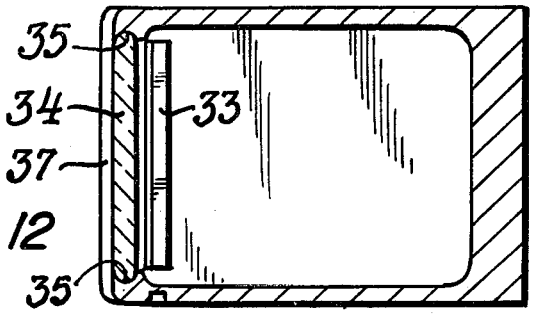
FIG. 12
FIG. 13
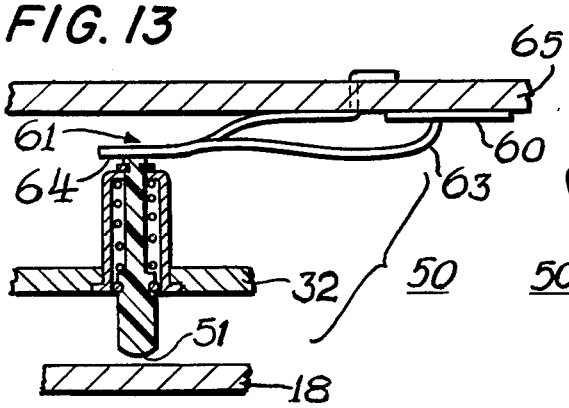
FIG. 14
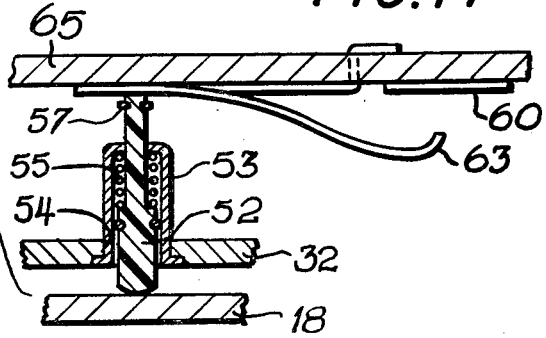

POP-UP CASE AND RELATED DISPLAY CONTROLS IN AN ELECTRONIC WRISTWATCH

This invention is for use in an electronic wristwatch, especially a quartz crystal type wristwatch with electronic information display, and comprises advantageous features in the configuration and arrrangements of parts therein for the switching on and off of that information display and for presenting that display for viewing by the wearer.

Electronic quartz crystal digital watches can and usually do have far greater accuracy than previous watches, and their presentation of time information in digital form is increasingly preferred over the previously prevailing analogue style.

The electronic digital appears able to give the public what it most wants, on two conditions: one, that the small batteries contained in the watch can last long enough (desirably one year) when used for timekeeping and also for information display which can use up energy at ten thousand times the rate of use for timekeeping, and two, that the provision for turning displays on—for so long as needed but not more—are convenient and easy to use.

This invention makes a departure in approach and gives important steps forward in conserving battery energy when time information is displayed and in giving more convenient actuation. At the same time it makes the viewing of the display easier for the wearer of the wrist watch.

Some of the features of my invention are these: The watch case is pivoted at its outer end to a seat which it normally is recessed in. A manual pushbutton releases a detent and allows a spring to push the inner end of the watch case up far enough for its display panel—which occupies the inner vertical end of the watch case—to pop up sufficiently to expose that panel's time information display to the view of the wearer. A demand switch, which in part controls the display, has a plunger which projects from the under side of the watch case and moves out—closing the demand switch—when the case pops up, and is moved back in—opening the demand switch—when the case is pushed back down close to the floor of the seat. Popping up of the watch closes that switch and turns on the first phase of the display. For each phase the display will stay on for a predetermined duration and then go dark unless before that predetermined time has expired the watch's demand switch is opened and then again closed (by pushing the case down then letting it back up) whereupon the display moves to its next phase. When the final phase (seconds, in the present embodiment) has had its time expire or—before its time expires—has had the demand switch again open and close, the display progresses to the next phase, which is Dark, and the panel will stay dark whether the case remains up or is pressed fully down into the seat so the detent holds it there. The foregoing is more convenient than manipulating pushbuttons for the phases after initial turning on of the display, and for the same amount of useful viewing tends to consume less total drain on the battery or batteries which are carried in the watch assembly.

In the drawings,

FIG. 9 is a side elevation with the rear portion in section.

FIG. 10 is a bottom view of mainly the seat member, with one end detail seen in section.

FIG. 11 is a front end view of the watch with its case popped up.

FIG. 12 is a horizontal section of the case, looking down on the line 12—12 of FIG. 9.

FIGS. 13 and 14 are details, partly in section, of the demand switch which is initially controlled by the manual pushbutton.

The wrist watch of my invention uses a quartz crystal oscillator and one or more batteries, accomodated in a watch case with other electronic and electro-optical components and circuitry such for instance as those of the ICM 7200A Alpha-numeric Day-Date 12 hr chip described in September 1975 8-page bulletin "COMPLEMENTARY MOS LED CIRCUIT, APPLICATIONS REQUIRING SPST SWITCHING", Intersil ICM 700A, ICM 7202A, ICM 7203A and 7204A by Intersil, Inc. 10900 N. Tantau Ave., Cupetino, Calif., U.S.A. 95014.

Figure 1:
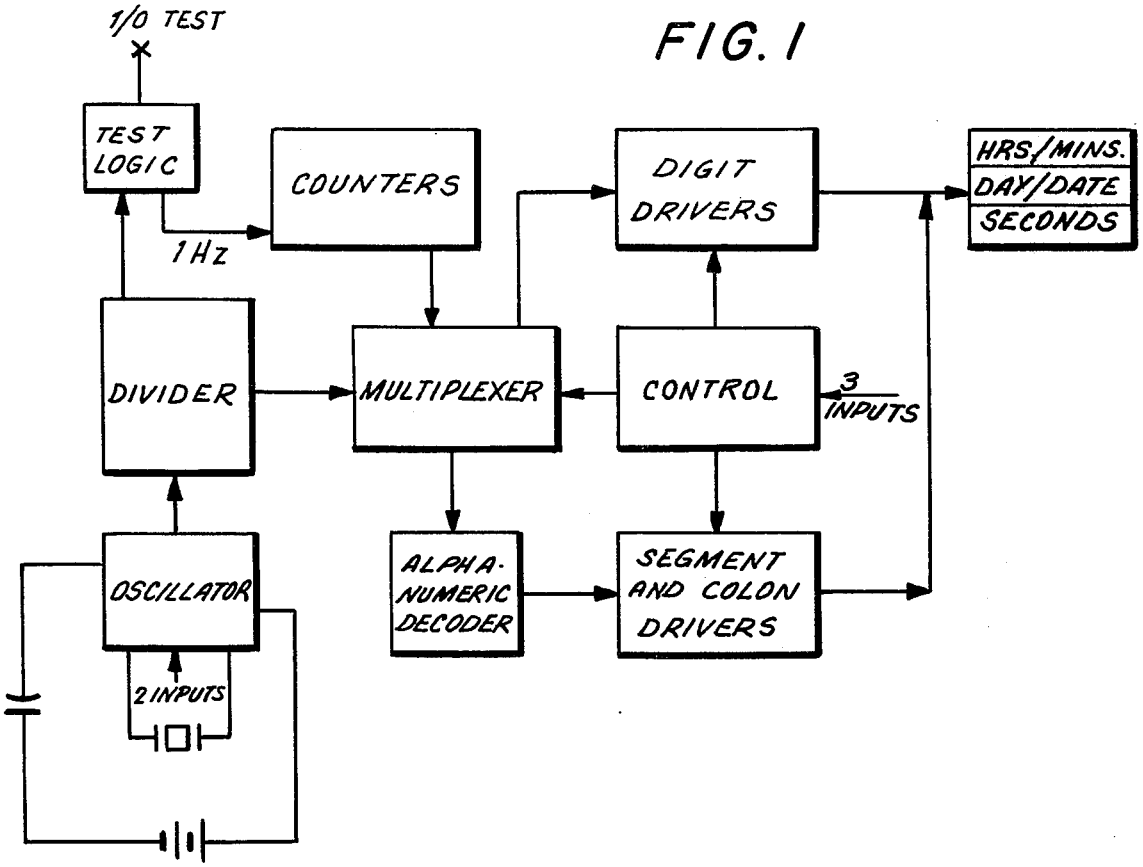
FIG. 1 is a block diagram indicating the nature of the timekeeper with which the features of the present invention may be combined.
Figure 2:
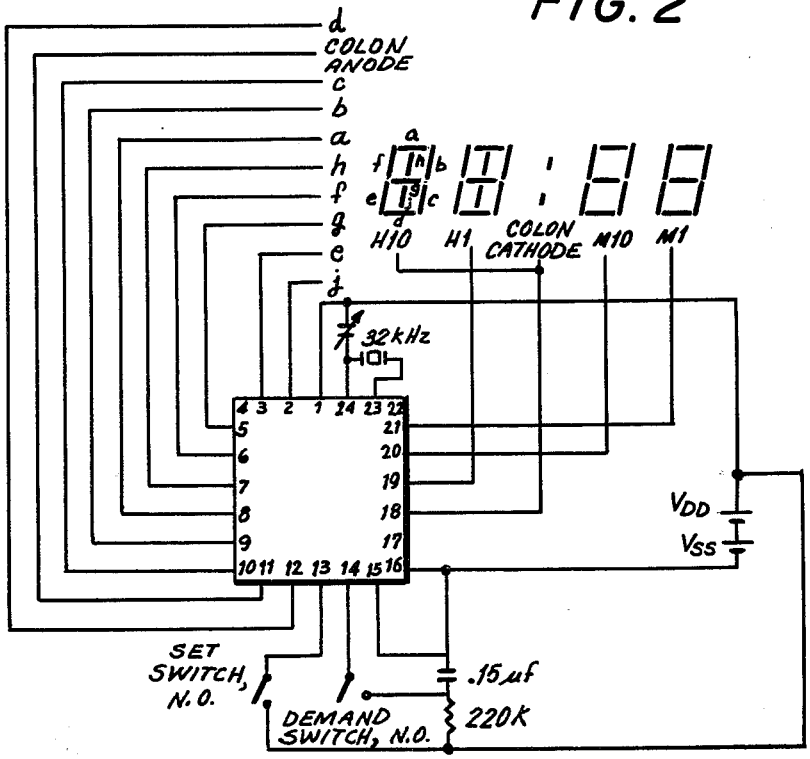
FIG. 2 is a diagram indicating something of the time display that is used and something of the applicable interconnections and switching; the resistor/capacitor portion at the bottom of the figure being however added by applicant for the purposes of the present invention.

My wrist watch in the presently preferred embodiment uses electronics supplied by Intersil, Inc. and diagrammed in FIGS. 1 and 2 hereof which are essentially taken direct from the bulletin identified in the immediately preceding paragraph hereof. FIG. 1 includes some parts not shown in the Intersil diagram, and a change has been made at the bottom portion of FIG. 2. This is better explained after the various parts of my watch have been introduced.

The illustrated wristwatch embodying my invention has a seat 10. That seat has low upstanding structure in the nature of walls, one along the side nearest the wearer's left hand, and one along the near end of the wristwatch. "Near end" herein means nearest the right side of the wearer's left wrist with his palm down, i.e. thumb side, and "far end" means nearest the left side of that wrist, i.e. little finger side, when viewed similarly. Preferably, though not essentially, the seat has a third such wall along the other side, i.e. the side that is farther from the wearer's hand.

A generally rectangular cradle floor 18 fits against the under side of the wall parts, or upward structure, 11, and is secured thereto. A steel ribbon spring 19 is secured on top of the floor member in the vicinity of the seat's far end. It extends toward the near end and in so doing curls upward and presses upwardly against the under side of the watch case.

The watch case 30 comprises a squarish inverted cup-like member having a top and two side walls, and a closed end wall at the far end of the watch case. This closed wall at the far end has a square notch 31 formed in it transverse to the case, at the lower edge, and extending for the central portion only of the length of the end wall.

The case has secured to it a flat bottom 32, which is generally coterminous with the walls of the case.

My wristwatch has fastening configurations at its ends. This placement is of course conventional, but its recitation helps in verbally orienting structure involved in my invention.

Figure 4:
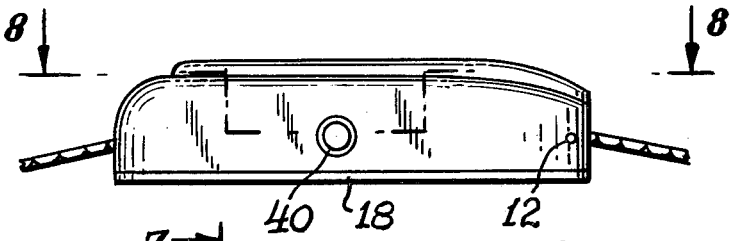
FIG. 4 is a side elevation thereof.

The sleeve of a joining pin fits across the far end of the case, through cylindrical holes made for it in the extending shoulder portions of the case to the sides of the notch 31 (which shoulder portions may be solid, or hollow and encased), and at that notch through the end pin-receiver sleeve **15*f* formed on the far end of the band 15. In the tip portions of the arms of the U-shape wall parts of the seat two small holes 12 face each other, to receive the retractable joining pin 13. One of these holes is visible in FIG. 4**; its mate is equal and opposite.

The pin's spring-extended slender ends fit into the holes 12 near the tips of the bezel member. It will be seen that the watch case, the far end of the band 15, and the bezel, are all here joined together by the pin 13 and are each and all pivotable about this pin.

Figure 3:
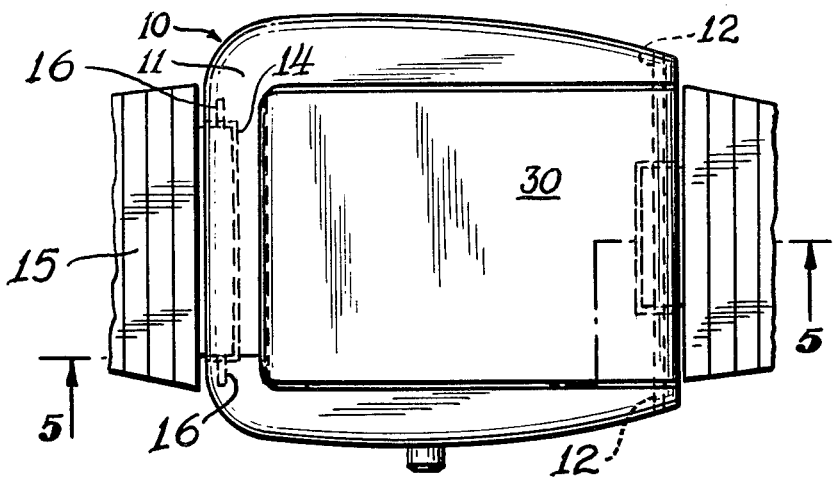
FIG. 3 is a top plan view of a watch in accordance with my invention.

The back portion of the seat portion at its near end is undercut for a central part of its width as at 14 (see FIGS. 3, 5 and 10) to receive the rolled-over end **15*n* of a band 15. Holes 16 facing each other (FIG. 3) are formed at the ends of the undercut 14 to receive the ends of a retractable joining pin 17 which holds the near end of the band 15** to the seat. It will be noted that the fastening for a wrist band of the wristwatch's seat here at its near end is independent of hinging motion of the watch case.

A preferably red glass window 34 (FIG. 12) fits into vertical grooves 35 provided for it at the near ends of the side walls of the case 30. This glass constitutes both a front end enclosure and a sufficiently transparent window for the display, giving contrast enhancement in a known manner. The top above this glass has a full length short forward projection 36 (FIG. 6) which constitutes a narrow canopy; this reduces a little the amount of ambient light coming over the wearer's head and falling on the glass panel.

At its front end, the case's floor projects a short way out beyond the case and specifically out beyond its glass front end panel, forming a narrow ledge 37. When the case is released from being held recessed in the seat the spring 19 pushes it up, (FIG. 6) the case pivots on the pin 13 at its far end, and the front end of the case angles up to where its ledge projection 37 catches under lip 38 formed along the inner edge of the top of the near end of the seat's upward structure serving as a stop which holds the display panel to approximately where said panel is exposed for viewing, with little or no excursion therebeyond.

I have observed that after a wristwatch has been donned and worn long enough to be acted upon by arm motions it tends to come to rest not flat on top of the wrist but farther out, near the little finger side of the wrist. This requires the wearer, in order to get a full-face view of his watch, to twist his wrist inwardly at the top, which is an awkward motion. With my watch whose display extends mainly upward (with a small outward component) the wearer can read its display by rolling his wrist a little outward at the top, which is a distinctly easier motion and indeed a position his wrist is far more apt to be already in.

Figure 5:
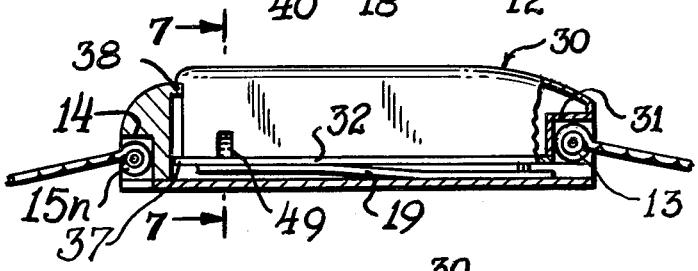
FIG. 5 is a vertical longitudinal section taken on the line 5—5 of FIG. 3, showing the watch case recessed in the seat.

When the case is recessed, its display panel and the near end wall of the seat are close to each other and directly face each other and the display panel is occluded from view by the end wall, as is particularly evident in FIG. 5.

Figure 7:
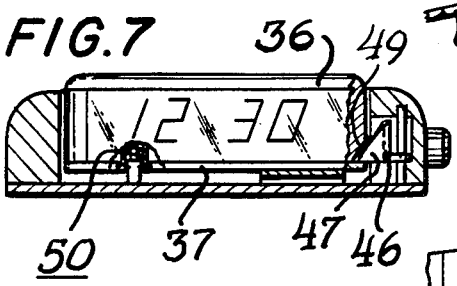
FIG. 7 is a vertical transverse section taken on the line 7—7 of FIG. 5.
Figure 8:
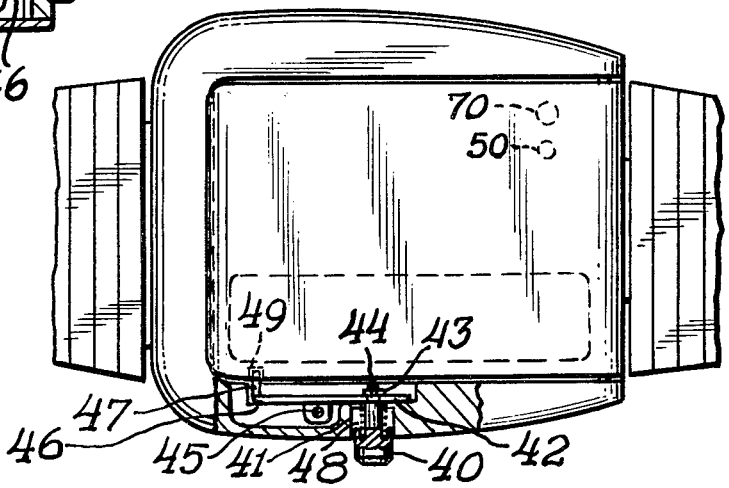
FIG. 8 is a top view, partly in section (on the line 8—8 of FIG. 4) showing more detail of the pushbutton and detent mechanisms.

The presently preferred pushbutton arrangement for holding the case recessed until release is desired, and then releasing, is seen in FIGS. 7 and 8. The cylindrical pushbutton proper 40 fits in bore 41 in the bezel 11. It is prevented from falling in or out by passing it into the bore then through detent lever arm 42, then putting a C-ring pinch collar 43 in the reduced diameter groove in front of the integral head 44.

Detent lever arm 42 is pivoted near its center by pin 45 whose ends are journaled in the walls of the seat's upward structure 11 (in a cavity extending into the bezel from the inner face of its right branch.) The near end of the detent lever 42 is bent on the vertical line 46 to give a latch 47 which is pressed against the side of the watch case by action of the compressed spring 48. This place on the side of the watch case is hollowed with a cavity 49 inward and down to—but not including—the immediate portion of the floor of the watch case, which floor is firmly secured to the rest of the case. As a result the projecting latch 47, sloping out and down to stop with a rather abrupt point, fits in the negative slope in the side of the case, to where it meets the floor of the case and holds it—and thereby the case—down in recessed condition. When the pushbutton 40 is pushed inwardly of the bezel (to the wearer's left as the watch is worn on the left wrist) it moves the opposite end of lever arm 42 to the right, retracting the lever's projecting catch 47 from the local shelf region of the case's floor, and allows spring 19 to push the watch case up with a quick "pop-up" action. The case pivots up to where the previously-mentioned projections 37 and 38 meet and serve as limiting stops. It is evident that the case can be recessed again by simply pushing it all the way down. The recessing of the case nestles it into the more or less sheltered recess formed by the floor member and whatever plurality of walls is present.

The popping up and the recessing of the watch case govern the condition of the demand switch 50, which is located in the watch case with a projecting element that senses the case's relation to the seat it recesses in.

The demand switch 50 is seen in FIGS. 13 and 14, and FIGS. 5, 6 and 7 indicate its relation to the seat. A foot 51 of the demand switch stem 52 projects outside the watch case, below it. This foot contacts the seat's floor 18 when the watch case is recessed. The foot 51 is the bottom end of a plastic non-conducting stem 52 passing through a sleeve 53 in a hole 54 in the watch case floor. A coil spring 55 between a shoulder on the stem 52 and the top of the sleeve 53 urges the foot downward but the distance the foot can project is limited by a collar 57 on the stem above the sleeve.

The switch contacts are made of sheet metal. Various forming processes may be chosen. My present set of choices is illustrated. The flat contact 60 is a metal area left when a thin sheet of metal was electroplated onto the chip or circuit board and in places etched away.

The resilient clip-like cooperating switch member 61 is of thin springy sheet metal and may also have been formed by plating, or as one alternative, by stamping. It is located on or at the under side of an insulating circuit board 65 which is secured above the floor of the case. The clip member 61 also is formed in the approximate trident shape seen in broken lines in FIG. 10, and is bent as seen in side view in FIG. 13. This bending includes a reverse bend: down away, and then back to more or less parallel below the circuit board. The effect obtained by this bending or otherwise is to give see-saw action so that, when its left end as seen in FIGS. 13 and 14 goes up, its right end comes down.

The free ends of the two wing prongs 62 of the trident, or metal extensions thereof, are formed at right angles to go through the board to its other side and are there bent over at right angles again, and additionally secured if necessary, holding the clip in place and providing electrical contact at the top side of the board. The central prong or tongue is bent upward near its tip toward those angled-over wing prongs, enough so that at rest its tongue presses against fixed contact 60. The slight rest-position pressing of the stem of demand switch 50 upward against the butt portion 64 of the trident as seen in FIG. 13 does not overcome tongue 63's resilient rest pressure against contact 60. However when the watch case, which the demand switch is built into, is recessed and its demand switch 50 is moved down close to the seat's floor 18, as seen in FIG. 14, the foot 51 of the demand switch's stem 52 meets the floor 18 and is pressed up relative to the case, pushing up the butt 64 of the trident and swinging the tongue 63 down away from contact 60, opening the demand switch 50.

The case is provided with various components and circuits as its works. These are for the most part like those already found in quartz crystal digital wrist watches and are not shown other than by FIGS. 1 and 2. However, the display panel 33 is arranged distinctively. In FIG. 12 it is shown, in its location just inward of, close to, and generally parallel to, the red window 34. It is thus generally perpendicular to the top of the watch case and extends across the case close to its near end. At its face adjacent the red window the display panel carries the four sets of bars, and the colon, that are shown at top right of FIG. 2. Some indicia formed by lighting up selected bars on the display panel are visible at the near end of the popped-up case as seen in FIGS. 7 and 11.

Figure 6:
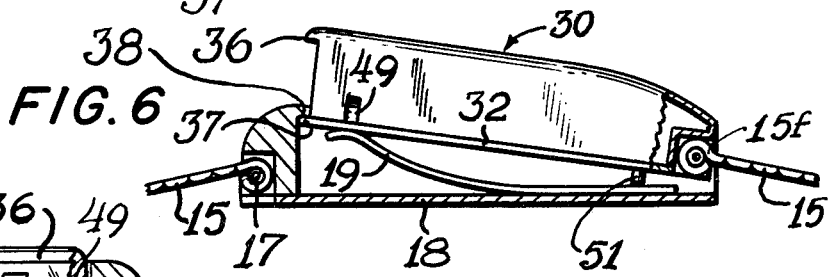
FIG. 6 is a view similar to FIG. 5 but showing the display end of the watch case popped up out of the seat.

The demand switch 50 in the floor of the case is located back fairly close to the pivot pin 13. More specifically the distance from pivot pin to demand switch may desirably be about 15% of that from pivot to front end of case. The length of the demand switch's stem is so chosen—in relation to other dimensions such for example as the open-condition gap of the switch contacts—that while the demand switch is closed when the case is in its up position the switch will be opened by pushing the case down through about two or three degrees. As seen in FIGS. 6, 7 and 8, this is distinctly less than all the way down to where the detent 47 latches the case in recessed condition.

The Intersil circuitry is apparently planned for use with a demand switch that is momentarily pressed and thereby momentarily closed, and then let go. The chip circuitry holds the appropriate display circuit closed until the counter serving it opens it. In the watch of my invention the demand switch goes from open to closed and may remain there for some time or even indefinitely. Therefore, as seen at the bottom of FIG. 2, I have incorporated in the watch circuitry the small capacitor and large resistor across the battery leads, with the capacitor being connected through the demand switch to that display circuit which is conditioned to receive it. By this means the display circuit will feel only an instantaneous voltage to turn it on, and not feel any such voltage while the demand switch is perchance protractedly remaining closed.

The set switch 70 may conveniently be located next to the Demand Switch 50.

OPERATION

The time train starting with the crystal oscillator, whose adjusted frequency optimum is 32,768 Hz, is to be connected with the battery at all times that the watch is running. The three live stages of the display (in a box at right of FIG. 1) are to be normally disconnected from the battery, to avoid battery drain.

When the case is popped up by pressing the pushbutton the demand switch is thereby closed. This does two things. One, it lights up (or otherwise electro-optically makes visible) selected bars at the face of the display panel, to present the first output, to wit Hours and Minutes. Two, it starts a counter running. If, by the end of a pre-set time, for instance 1.5 seconds, the demand switch has not moved from an open position to a closed position again, this counter will disconnect the battery from the display panel, and the time display will be thereby extinguished. Every time this happens, in any phase of the display, the chip circuitry will condition itself again so that the next closing of the demand switch from an open position will once more actuate the HRS/MINS. display.

If however, before that preset time has run, the demand switch be opened and closed (as by giving the watch case a quick, light push down about an eighth of an inch and smartly releasing) Display 1 will be extinguished and Display 2 (DAY/DATE) will turn on, as will a counter set to run say 1.5 seconds.

If that time runs, the counter turns off the display and reconditions the circuitry so that when the demand switch is next turned on Display 1 will activate. If the wearer bobs the case down and up before the counter has run its pre-set period, the currently lit Display 2 will extinguish, a counter will start, and Display 3 (seconds) will light up and will show the successive seconds as they occur until about sixty have successively lit up. The counter running at the time of Display 3 has a pre-set length of time to run, which may be about sixty seconds. If the counter runs its full term it then turns off Display 3, and the display panel is dark. If before the counter's full term has run the wearer pushes his watch case down a little and lets it pop back up, this turns off Display 3. In either case the display will remain dark until the demand switch is next opened and closed, whereupon Display 1 lights up. The difference is that turning off by the "down and back up" action turns off the seconds display instantly, without using up all that remains of sixty seconds of battery drain. For the common wearer, who does have occasional interest in knowing whether the indicated minute has just barely started or is close to turning into the next minute, but who doesn't do much timing of duration of events in seconds, this can considerably extend the length of use of his watch between battery replacements.

It should also be noted that the watch can be worn with case up but panel dark, for long periods if desired. A person needing frequent time information but not having two hands free to devote even momentarily, can advantageously operate this way, pressing the case in by touching it to his person or to some nearby object, instead of touching it with his other hand.

I claim:

1. Device for a wristwatch having fastening configurations for a wrist band, including a watch case and a seat for said case, the case having an end wall comprising a display panel for displaying information developed within the watch case, and the seat having an end wall corresponding with the case's display panel end wall, and having at least one side wall and a floor member, said seat's walls and floor member being of size and shape to receive the watch case to be at least partially recessed therein and to thereby at least largely occlude the display panel from sight when the case is in down position nestled down near the floor and within the walls, said device including two fastenings for fastening the case to the seat structure, namely a first fastening which secures the case from separation from the seat but does not prevent said case from having some limited hinging motion about an axis which is transverse to the wristwatch, and which axis is at a watch's far end region relative to the wearer's body, the just specified locus of motion including from where the watch case is at least largely cradled within the seat to where it is angled out from the seat enough so the display is at least largely outside the seat and readily viewable, and a second fastening which holds the watch case nestled down in the seat until this second fastening is released and thereupon allows the case to move relative to the seat within the locus permitted by the first fastening, stop means limiting that relative motion, and a display panel switch carried by the case and controlled by motion of the case relative to the seat.

2. In a device for a wristwatch, a U-shape seat having portions which give it its U shape, said portions including arm portions with tips, said seat also having fastening configurations for a wrist band to hold the watch on a wrist with its near end closer to, and its far end farther from, such wearer's body, a watch case carried by the seat and movably fastened thereto, a display panel in the case and a switch controlled by motion of the case relative to the seat, and in which a floor member is secured to said seat, and the outer end of said watch case is pivotally secured to the seat near the arm tips of the U-shape seat.

3. Device for a wristwatch, having a near end and a far end, (see specification), having at its said end regions fastening configurations for a wrist band, having a seat and a watch case and each of them having a near and a far end, the case having a display panel at the region of its near end, the wristwatch's fastening configuration for a wrist band at its near end being on the seat and independent of the watch case, the wristwatch's far end fastening configuration comprising a common pivotal fastening of the seat and the case and the band, which holds the three together and allows independent pivotal motions thereof, said wristwatch having also a display circuit, and having a switch in said circuit controlled by motion of the case relative to the seat.

4. Device for a wristwatch including a case bearing a display panel, said wristwatch including a seat for the case, which seat has fastening configurations for a wrist band, and in which the case is carried by the seat and hingedly fastened thereto at one end of the seat, the seat having a plurality of upstanding walls, including one across its near end and one along a side, forming a somewhat enclosed recess space within which the case can be at least partially recessed, in which wristwatch also a manual pushbutton is provided projecting from the outside into a seat wall and having a latch projecting from the wall within the seat's confines and engaging the case there and holding it down until the pushbutton is pressed whereupon it moves the latch to allow the watch case to angle upwardly about its hinged fastening to the seat.

5. Device for a wristwatch designed for ruggedness and low energy load: a seat comprising upstanding walls and a floor member which together provide a recess to said seat, a watch case approximately conforming with said recess in horizontal size and shape and being capable of lying largely within the recess of said seat, said case being pivotally attached to the seat at one end of the case and bearing a display panel at the other end of the case, and while remaining attached to the seat being movable between one position, in which the watch lies largely within the seat and the display panel cannot readily be viewed by a wearer, and another position in which the watch case is angled up about the pivotal attachment enough to bring the end bearing the display panel at least mostly out of the seat, an electrical path to the display panel which path is carried by the case and which path controls the display condition of the display panel, and an automatic switch that includes a motion sensor, which switch is electrically in said electrical path and which motion sensor is mechanically secured in said wristwatch positioned at least near the seat and at least near the case and where it will be thrown when the case is angled out of the seat and again when it is recessed into the seat.

6. Device of claim 2 in which has a curled ribbon metal spring which resiliently urges an end of the case upwardly.

7. Device of claim 2 in which a ribbon spring is secured flat on the floor of the seat at a location near one end and is free and upwardly curled as it goes from there toward the other end.

8. Device of claim 1 in which the wristwatch has a near end and a far end, said far end being the wristwatch's outer end, and the wristwatch's bezel and case have ends corresponding to those of the wristwatch, and the configuration whereby the outer end of the case is pivotally secured to the bezel provides thereby a pivot axis of the case, in which the display panel is at the near end of the case, is generally parallel to the pivot axis of the case, is generally perpendicular to the top of the case, and is substantially occluded by recessing of the case.

9. Device of claim 1 in which the case has a top and edges including a top near edge and in which the top near edge of the case has a narrow canopy formed across it projecting out over the display window, and over the adjacent edge of the seat when the case is recessed.

10. Device of claim 1 in which the seat has a near end portion which has an upper inner edge location which extends along for a finite distance, and in which the case has a near bottom edge location which extends along for a finite distance, in which the near end of the seat, along its upper inner edge, has a rearwardly projecting lip, and the case along its near bottom edge has a lip projecting forwardly, which lips meet when the case is spring-pressed upwardly and limit its such motion.

11. Device of claim 1 in which the switch includes a circuit board and openable and closable contacts formed, one, called the first contact, as a fixed area of metal deposited on the circuit board and the other as a movable piece of sheet metal also mounted on the circuit board but deformed to have one end region thereof bent away from the board and this portion carrying a tongue extending to the first contact and touching same when the bent-away end is allowed sufficient clearance from the board and pulling back from the board when the bent-away end is forced far enough in toward the surface of the board.

12. Device of claim 5 in which the case has a bottom region denominated as the bottom part of the case, and it has a lowermost integument enclosing the case from the underneath direction, the which is denominated as the case's bottom and in which the switch is mounted at the bottom part of the case, a hole is formed in the case bottom, and the switch includes a stem projecting through said hole and, when the case is recessed applying the upward push to open the switch.

13. Device of claim 5 which (a) has a stem is of non-conducting material and wherein there a sleeve provided as a part of the switch, and that sleeve fits in the hole and the stem extends through the sleeve and a coil spring is provided inside the sleeve and encircling the stem.

14. For an electronic digital wristwatch, having a seat which has fastening configurations for a wristband, a watch case which is carried by the seat and is movably fastened thereto, a display panel in the case and a switch controlled by motion of the case relative to the seat; wherein said seat provides a recess for the case to at least partially enter, the seat on the right side, i.e. toward a wearer's left hand, has: a longitudinal niche open inwardly to the seat's recess: a bore from the right side into this niche; a stemmed pushbutton in the bore; and a lever arm with generally mid region pivot is vertically pinned in the niche, the pushbutton stem bears upon one end of said arm, a camming detent is formed at the other end of the arm, a cooperating cavity is formed in the side of the case with a small ledge area just below the detent projection, and a spring urges the pushbutton outwardly and the camming detent inwardly.

15. In an electronic digital wristwatch, a watch case, a seat having therein a recess large enough in width and length to receive the watch case and deep enough to receive most of its depth and having fastening configurations for fastening thereto a band adapted to fit around a wearer's wrist and hold said bezel in generally fixed relation thereto, the watch case including means for generating time signals and also including a display panel, which watch case is movably so attached to the bezel that it can be recessed therein with its display panel thereby hidden and also while still attached can be less recessed and have its display panel openly viewable by a wearer, a detent for holding said case in the recessed location in which its display panel is hidden, a spring urging that portion of the case which bears the display panel to the more open location in which the display panel is viewable by a wearer, and a manual release for said detent.

* * * * *